US010669858B2

(12) United States Patent
Mozharov et al.

(10) Patent No.: US 10,669,858 B2
(45) Date of Patent: Jun. 2, 2020

(54) GAS TURBINE BLADE AND MANUFACTURING METHOD

(71) Applicant: General Electric Technology GmbH, Baden (CH)

(72) Inventors: Alexey Mozharov, Baden (CH); Andreas Bauer, Baden (CH); Dominic Graf, Baden (CH)

(73) Assignee: General Electric Technology GmbH, Baden (CH)

( * ) Notice: Subject to any disclaimer, the term of this patent is extended or adjusted under 35 U.S.C. 154(b) by 384 days.

(21) Appl. No.: 15/397,810

(22) Filed: Jan. 4, 2017

(65) Prior Publication Data

US 2017/0204729 A1 Jul. 20, 2017

(30) Foreign Application Priority Data

Jan. 15, 2016 (EP) ..... 16151556

(51) Int. Cl.
*F01D 5/18* (2006.01)

(52) U.S. Cl.
CPC ..... *F01D 5/18* (2013.01); *F01D 5/181* (2013.01); *F01D 5/186* (2013.01); *F01D 5/187* (2013.01); *F05D 2230/10* (2013.01); *F05D 2230/80* (2013.01); *F05D 2230/90* (2013.01); *F05D 2240/304* (2013.01)

(58) Field of Classification Search
CPC . F01D 5/18; F01D 5/187; F01D 5/181; F01D 5/186; F05D 2230/90; F05D 2230/80; F05D 2240/304; F05D 2230/10
See application file for complete search history.

(56) References Cited

U.S. PATENT DOCUMENTS 4,601,638 A * 7/1986 Hill ..... F01D 5/186 415/115
2002/0119730 A1 8/2002 Dean et al.
2008/0175714 A1 7/2008 Spangler et al.
(Continued)

FOREIGN PATENT DOCUMENTS

DE 112009001506 T5 4/2011
EP 1431514 A2 6/2004
(Continued)

OTHER PUBLICATIONS

David Gordon Wilson, "The Design of High-Efficiency Turbomachinery and Gas Turbines",MIT press, 5th printing (1991), 487-492, Cambridge 20 Massachussetts, USA.
(Continued)

*Primary Examiner* — Jacob M Amick
*Assistant Examiner* — Charles Brauch
(74) *Attorney, Agent, or Firm* — Fletcher Yoder, P.C.

(57) ABSTRACT

A blade for a gas turbine is described, the blade comprising a trailing edge and a trailing edge cooling channel extending from a first upstream end to a second downstream end, in which the width of the trailing edge cooling channel in the direction perpendicular to the camber line of the blade varies and the narrowest width in the trailing edge cooling channel is at the first upstream end, so as to provide a blade where the trailing edge can be removed with a minimal change or no change in the cooling flow capacity through the trailing edge cooling channel. Related methods are also described.

16 Claims, 2 Drawing Sheets

(56) References Cited

U.S. PATENT DOCUMENTS

| | | | | |
|---|---|---|---|---|
| 2009/0313823 | A1 | 12/2009 | Rockstroh et al. | |
| 2010/0166564 | A1* | 7/2010 | Benjamin | F01D 5/188 416/223 R |
| 2010/0247290 | A1* | 9/2010 | Hada | F01D 5/189 415/115 |
| 2014/0322008 | A1* | 10/2014 | Molter | F01D 5/186 416/1 |
| 2014/0377075 | A1 | 12/2014 | Warikoo et al. | |
| 2015/0037165 | A1* | 2/2015 | Jones | F01D 5/186 416/232 |
| 2015/0096305 | A1 | 4/2015 | Morgan et al. | |

FOREIGN PATENT DOCUMENTS

| | | | |
|---|---|---|---|
| EP | 1527845 | A2 | 5/2005 |
| EP | 1612372 | A1 | 1/2006 |
| EP | 2163726 | A1 | 3/2010 |
| EP | 2781691 | A1 | 9/2014 |

OTHER PUBLICATIONS

European Search Report and Opinion issued in connection with corresponding European Application No. 16151556.4 dated Jul. 27, 2016.

* cited by examiner 50
50
18
30
b
24
12
40
32
40
16
c
a
A 10
12
32
16
22
14
20
18
30

GAS TURBINE BLADE AND MANUFACTURING METHOD

TECHNICAL FIELD

The present disclosure relates to a gas turbine blade, and particularly to a gas turbine blade with a trailing edge cooling channel.

BACKGROUND

Gas turbine blades in modern gas turbine engines are extremely complicated and include various aerodynamic and cooling features. Design and testing of new blades typically takes years and considerable amounts of money. Considering this, a new blade design approach and manufacture method have been developed that can allow for increased flexibility, resulting in a considerable reduction in manufacturing development effort and costs.

BRIEF DESCRIPTION

An aspect provides a blade for a gas turbine, the blade comprising a trailing edge and a trailing edge cooling channel extending from a first upstream end to a second downstream end, in which the width of the trailing edge cooling channel in the direction perpendicular to the camber line of the blade varies and the narrowest width in the trailing edge cooling channel is at the first upstream end, so as to provide a blade where the trailing edge can be removed with a minimal change or no change in the cooling flow capacity through the trailing edge cooling channel.

A gas turbine blade as described can allow for a modular solution to providing gas turbine blades, where a single design of blade can be modified for use in multiple gas turbine engines of differing design. With this design, a gas turbine blade for a particular gas turbine can be cut back to make it useable in a different gas turbine, with minimal or no loss in aerodynamic and cooling performance. For example, the flow of cooling fluid through the trailing edge cooling channel is affected only minimally or not at all by being cut back because the bottleneck for cooling fluid flow is maintained within the cut back blade, and is not lost when the blade is cut back. A minimal change is a change that does not seriously affect the cooling of the blade; this can avoid significant loss of blade lifetime.

This design can be considered to be providing a built-in modularisation opportunity, where a single design of blade can be modified after manufacture for use in multiple different designs of gas turbine, or for different applications within the same gas turbine.

In an embodiment, the trailing edge cooling channel comprises a pin field with the pins in the pin field extending across the trailing edge cooling channel in the direction perpendicular to the camber line. Pins near to the first upstream end are closer to one another than pins near to the second downstream end. The trailing edge cooling channel diverges in the direction of cooling fluid flow through the trailing edge cooling channel when in use. The trailing edge cooling channel diverges for at least half of the distance from the first upstream end to the second downstream end. The width of the trailing edge cooling channel in the direction perpendicular to the camber line is less in between the pins in the direction of the camber line than the width at the pins. The throat 34 in FIG. 4 is an example of this.

In an embodiment, the narrowest width is situated more than 5%, more than 10%, more than 15% or more than 20% of the chord of the blade from the trailing edge. This can allow a significant part of the blade at the trailing edge to be removed without significantly affecting cooling flow and cooling performance.

A second aspect provides a gas turbine comprising a blade as described above.

A third aspect provides a method of producing a blade for a gas turbine, the blade comprising a trailing edge and a trailing edge cooling channel extending from a first upstream end to a second downstream end, the method comprising the steps of manufacturing the blade, removing the trailing edge after manufacturing the blade, wherein at least 5%, at least 10%, at least 15% or at least 20% of the length of the chord of the blade is removed, and forming a new trailing edge. This can allow a blade designed for one gas turbine engine to be fitted into another gas turbine engine, or used for different applications in the same gas turbine.

In an embodiment, the blade is an unused blade and the trailing edge is removed from an unused blade. The new trailing edge is a straight, angled, curved or stepped trailing edge. These shapes provide different flow patterns around the trailing edge. The shape of the trailing edge after cutback can be chosen based on a required hot gas static pressure at the trailing edge. A thermal barrier coating is added to at least the trailing edge after a portion of the trailing edge is removed.

In an embodiment, the blade is a blade in which the width of the trailing edge cooling channel in the direction perpendicular to the camber line of the blade varies and the narrowest width in the trailing edge cooling channel is at the first upstream end, so as to provide a blade where the trailing edge can be removed with a minimal change or no change in the cooling flow capacity through the trailing edge cooling channel.

A fourth aspect provides a method of adjusting the hot gas flow capacity of a stage of a gas turbine, the stage comprising a plurality of blades, the method comprising the step of cutting away a trailing edge from at least some of the plurality of blades. In an embodiment, the step of cutting away a trailing edge is performed on all of the blades (i.e. all of the stationary vanes or all of the rotating blades or both). This method can increase the maximum hot gas flow capacity of a stage, which can avoid compressor surge, or influence the performance characteristics of the gas turbine set.

BRIEF DESCRIPTION OF THE DRAWINGS

An embodiment of the invention will now be described by way of example only and with reference to the accompanying drawings in which.

DETAILED DESCRIPTION

Some gas turbine designs, particularly iterative designs made by the same manufacturer, may have the same overall blade size and blade attachment as blades in previous designs; in other words, it may be physically possible to insert a blade designed for one design of gas turbine into another design of gas turbine. However, aerodynamic features of the actual blade need to be a particular size or shape depending on factors that vary between designs such as hot gas flow capacities and pressure ratios, and therefore different blade designs are needed in different designs of gas turbine.

The blade described herein is a new blade designed for one type of gas turbine that is also designed so that it can be modified for use in another gas turbine by cutting back the trailing edge. This relatively radical solution allows a single blade design to be used in two or more different designs of gas turbine engine. For example, in one design of gas turbine engine the blade could be used in its unaltered state, and a cut back version of the blade could be used in a second design of gas turbine engine. The ability to cut back a blade also allows for alteration of a blade to reflect a modification of an existing gas turbine or a change in use of a gas turbine or to achieve suitable performance characteristics for alternative applications. In one example, if the compressor massflow of a gas turbine is altered, then the blades could also be cut back. In another example, blades could be cut back to move between a maximum power optimised setup and a maximum efficiency optimised setup. In a third example, a gas turbine could move between optimised single cycle and combined cycle operation setups, or between optimised setups for different types of fuel by cutting back the blades, such as optimising for low energy fuel types (low Btu fuels).

Figure 1:
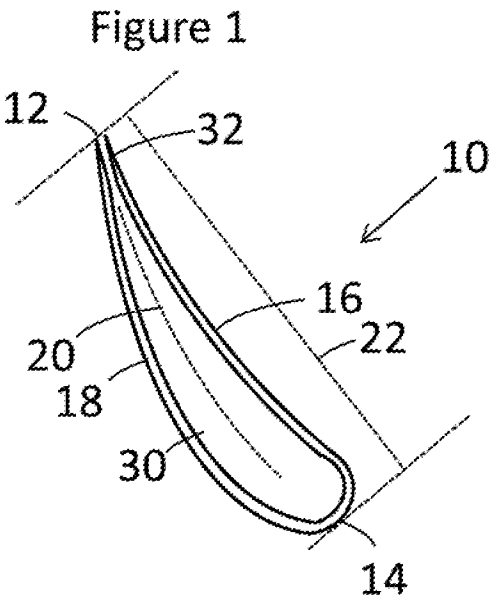
FIG. 1 shows a cross-section of a blade.

FIG. 1 shows a cross-section of a blade 10 in which the structures shown below can be provided. The blade has a trailing edge 12, a leading edge 14, a pressure surface 16 and a suction surface 18. Part of a camber line 20 bisecting the blade is shown, as is a chord 22 extending from the trailing edge to the leading edge. The blade comprises a cavity 30 within the blade and a trailing edge cooling channel 32 (cooling fluid channel) extending from the cavity between the pressure surface and the suction surface to the trailing edge. When the blade is in use in a gas turbine, cooling fluid passes through the cavity and the trailing edge cooling channel into a hot gas path.

Figure 2:
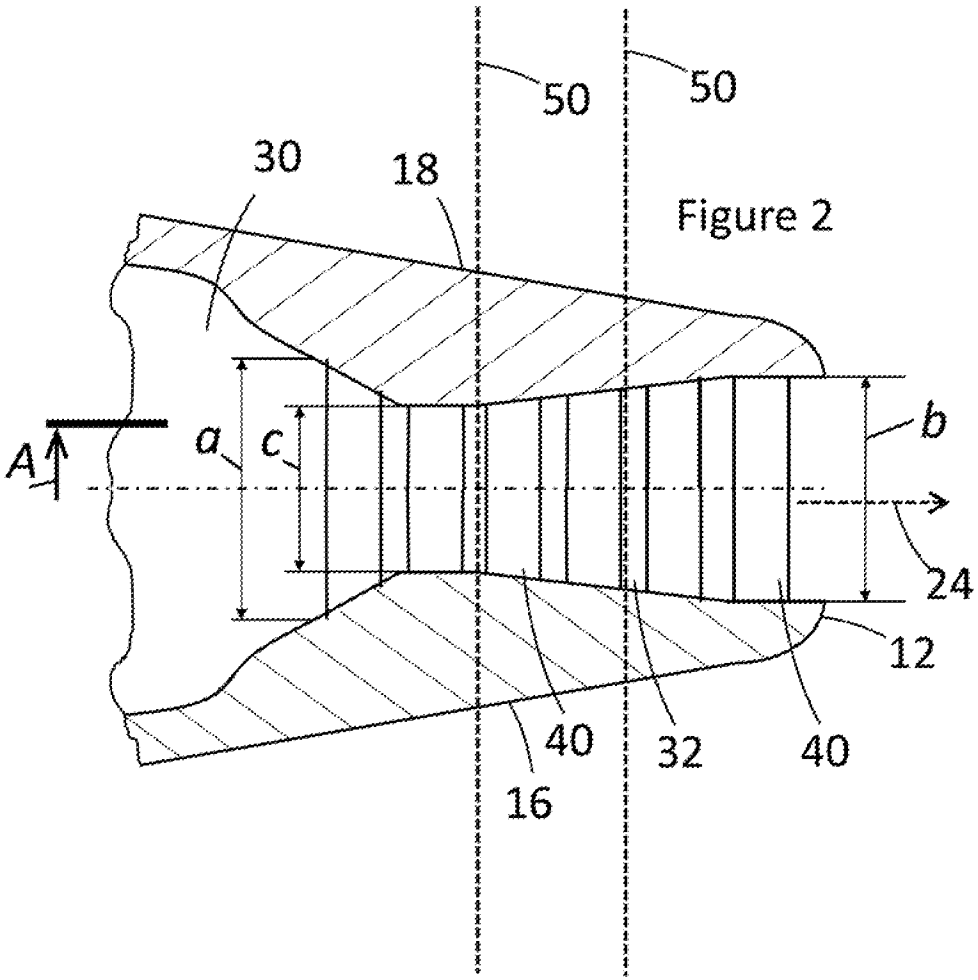
FIG. 2 shows a cross-section of the region of the blade of FIG. 1 near the trailing edge.

FIG. 2 shows a cross-section of the region of the blade near the trailing edge. The pressure surface 16 and suction surface 18 can be seen, along with the trailing edge 12, part of the cavity 30 and the trailing edge cooling channel 32. Pins 40 in a pin bank (pin field) can also be seen extending across the trailing edge cooling channel and in the cavity near the trailing edge cooling channel; six rows (lines) of pins are shown in total. The bottleneck (basically a throttle—this is the narrowest width) in the flow path can be considered as the start of the trailing edge cooling channel. The cooling fluid flow direction 24 is shown.

It can be seen in FIG. 2 that the width of the trailing edge cooling channel varies. Before the entrance to the trailing edge cooling channel, the cavity has a width a, and at the exit to the trailing edge cooling channel, the cooling channel has a width b. at the entrance, the trailing edge cooling channel has a width c. Width c is smaller than width b, and width b is smaller than width a. The narrowest part of the trailing edge cooling channel is at the point with width c. Downstream of the narrowest part the trailing edge cooling channel diverges when looking in the cooling fluid flow direction 24, and upstream of the narrowest part the cavity converges when looking in the cooling fluid flow direction 24.

Figure 3:
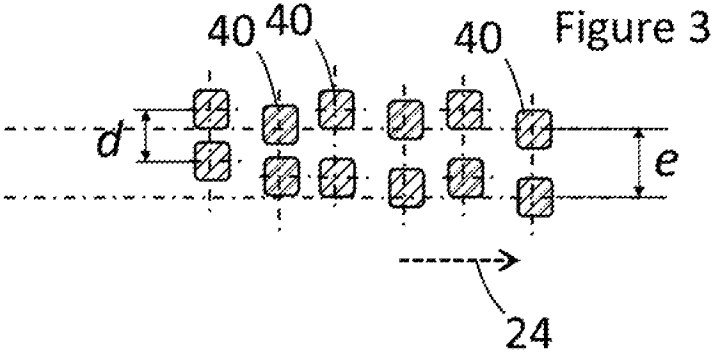
FIG. 3 shows a cross-section of the pins in the direction of arrow A of FIG. 2.

FIG. 3 shows a cross-section of the pins 40 of FIG. 2 in the direction indicated by arrow A in FIG. 2. The distance between adjacent pins in the most upstream row of pins is denoted by d, and the distance between adjacent pins in the most downstream row of pins is denoted by e. The distance d is smaller than the distance e, and the distance between adjacent pins increases in the cooling fluid flow direction 24.

Figure 4:
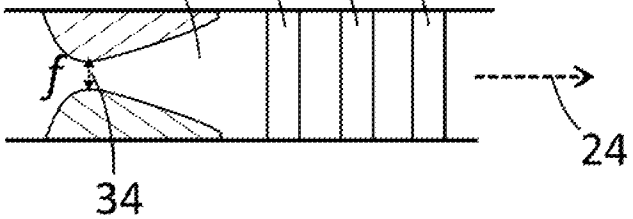
FIG. 4 shows a cross-section of an alternative trailing edge cooling channel shape.

FIG. 4 shows a cross-section of a trailing edge cooling channel 32 from the same view as in FIG. 2. Pins 40 can be seen, and upstream of or in between the pins 40 in the cooling fluid flow direction the trailing edge cooling channel 32 narrows to define a throat 34 with a width f. the width f would normally be less than the width e.

Widths a, b, c and f denote widths in the direction perpendicular to the camber line 20, so in the direction across the blade from the pressure surface 16 to the suction surface 18. Widths d and e denote widths in the direction of the trailing edge.

In a method of producing a gas turbine blade, a blade is manufactured in a first step. The resulting blade is in a form that allows it to be used in a particular gas turbine, with a particular aerodynamic setup. Thermodynamic setup may alternatively or additionally be an important factor. Relevant factors in the aerodynamic setup can include flow capacities (maximum flow rates) and pressure ratios in the turbine. In a different gas turbine with the same type of blade but with a different aerodynamic setup, it is generally not possible to use the same blade. In a second step in the method of producing a gas turbine blade, a portion of the trailing edge of the blade is removed to provide a blade with an increased opening width between adjacent blades. This can provide a blade for a different aerodynamic setup, allowing the blade to be used in a different design of gas turbine. As a result, this method of producing a blade can allow for a single blade to be designed for two or more different designs of gas turbine engine, thereby avoiding the need for designing and testing multiple different blades. As discussed above, this method can also allow for adjustments in the performance characteristics within the same gas turbine, potentially allowing the same gas turbine and blades to be used in various different applications.

Figure 5:
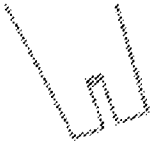
FIGS. 5, 6, 7, and 8 show cross-sections of trailing edges after being cut back.
Figure 6:
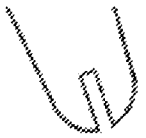
Figure 7:
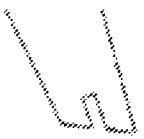
Figure 8:
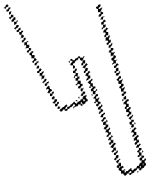
Figure 9:
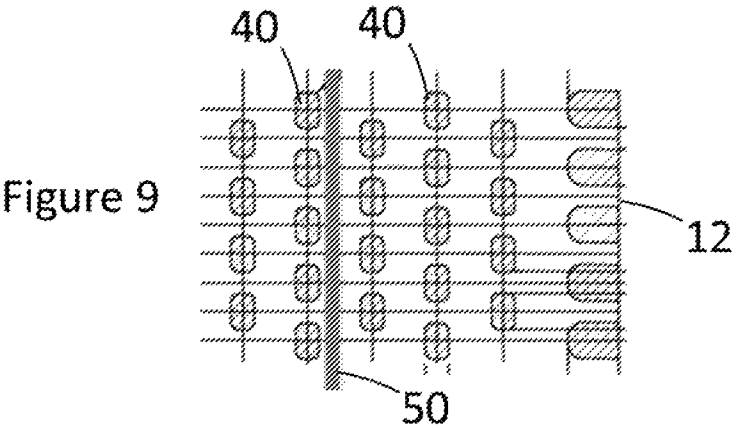
FIG. 9 shows a cross-section of a pin bank before being cut back.
Figure 10:
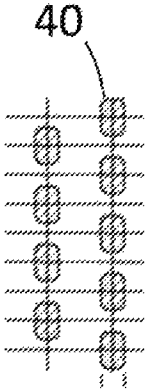
FIG. 10 shows a cross-section of the pin bank of FIG. 9 after being cut back.

Returning to FIG. 2, two cutback lines 50 can be seen, which show examples of possible cutback locations in the blade of FIG. 2. The end of the blade can be machined in various different shapes, with four examples shown in FIGS. 5 to 8. FIG. 5 shows a straight trailing edge; FIG. 6 shows a curved trailing edge; FIG. 7 shows an angled trailing edge; and FIG. 8 shows a stepped trailing edge. In FIG. 5, a straight cut is shown; this is the type of cut shown by the cutback lines 50 in FIG. 2. This design may be easier to carry out than most other cuts. FIG. 6 shows a curved trailing edge; this is the most efficient option in at least some designs. FIG. 7 shows an angled trailing edge. This is also a linear cut like those shown in FIG. 2 or FIG. 5, but the cut in FIG. 5 is perpendicular to the camber line 20, whereas the cut in FIG. 7 is at an angle from the camber line and is not perpendicular to the camber line. FIG. 8 shows a stepped trailing edge that has been cut back only on one side of the trailing edge cooling channel 32; the stepped trailing edge may provide efficiency savings over a linear or curved cut in at least some designs. FIG. 9 shows a top view of a pin field, so a view in the same direction as that in FIG. 3. The pin field has five rows of pins. After a cutback along the cutback line 50, the pin field shown in FIG. 10 is left behind, with two rows of pins.

The cutback may remove a total of at least 5%, at least 10%, at least 15% or at least 20% of the length of the chord 22. For example, a turbine vane 1 (in stage 1 of the turbine) is cut back by at least 10 mm, between 10 and 30 mm, between 15 and 25 mm or by at least 20 mm.

Normally, the cutback would remove some but not all of the rows of pins, leaving at least one row of pins. FIG. 2, for example, shows six rows of pins, and the cutback lines 50 remove two or four rows of pins. FIGS. 9 and 10 show the removal of three rows of pins, leaving two rows of pins. The cutback is intended to have a minimal or no effect on the maximum rate of cooling fluid flow (cooling flow capacity) leaving the blade through the trailing edge cooling channel, so that the cooling flow capacity is unchanged or similar to the rate in the blade before being cut back.

Many blades have a thermal barrier coating (TBC) on the outside. A portion of the blade will be left without a TBC after the blade has been cut back. In some designs, a new layer of TBC may be applied to the blade to compensate. Alternatively, the cut back may be performed immediately before the TBC is applied to the blade during manufacture of the blade, so that the TBC is also applied on the cut back trailing edge.

A gas turbine comprises a compressor, a combustor downstream of the compressor and a turbine. The blade 10 described above may be used as a blade (a rotating blade or a stationary vane) in the first stage of the turbine of a gas turbine. Blades as described could also be used in second or later stages of a turbine.

The terms used herein to describe the general parts of a blade (such as leading edge, pressure surface and chord) correspond to the definitions as set out in the glossary of terms on pages 487 to 492 of "The Design of High-Efficiency Turbomachinery and Gas Turbines" by David Gordon Wilson, as published by the MIT press, Cambridge Massachussetts, USA, $5^{th}$ printing (1991). The glossary of terms (pages 487 to 492) is hereby incorporated by reference.

Several example structures are described herein, but various modifications to these structures are possible. For example, the trailing edge cooling channel 32 is shown as being symmetrical along the camber line, but this is not necessary. The trailing edge cooling channel extends from the cavity to the trailing edge and allows cooling fluid to flow from the cavity out of the blade (into the hot gas stream).

The shape of the cross-section of the trailing edge cooling channel may be various shapes other than those described above. For example, the cavity and the trailing edge cooling channel may between them describe a de Laval nozzle, with a smoothed curvature (hourglass shape) with a converging section in the cavity upstream of the narrowest point in the trailing edge cooling channel and a diverging section downstream of the narrowest point. Similarly, the interpin throat (the throat 34 in FIG. 4) may be a de Laval nozzle. Where three or more rows of pins are provided, a de Laval nozzle may be provided either upstream of or in one or more of the spaces between the rows of pins.

The trailing edge cooling channel extends from an upstream end to a downstream end. The narrowest point in the trailing edge cooling channel is generally upstream of the majority of the pins.

The pins 40 may be organised in various ways, with the layouts in FIG. 3 and FIG. 9 being examples. The rows of pins normally extend in the direction of the trailing edge; for example, the rows of pins can be seen to be parallel to the trailing edge in FIG. 9, although the rows could also be at an angle from the trailing edge. The pin field normally extends more than 5%, more than 10%, more than 15% or more than 20% of the chord of the blade. The pin field may extend into the cavity 30.

Three distinct features are described in this application, namely a particular shape of trailing edge cooling channel (e.g. FIG. 2), a particular shape of pin field (e.g. FIG. 3) and a throat 34 between rows of pins. These features can be provided individually or in any combination.

Although cutback lines 50 are shown between pins in the examples above, the cut could also be made through pins. The remaining portion of the pins that are cut through would help to support the trailing edge, therefore ensuring that mechanical integrity of the component as a whole remains unaffected or is not significantly affected.

It is to be understood that even though numerous characteristics and advantages of various embodiments have been set forth in the foregoing description, together with details of the structure and functions of various embodiments, this disclosure is illustrative only, and changes may be made in detail, especially in matters of structure and arrangement of parts within the principles of the embodiments to the full extent indicated by the broad general meaning of the terms in which the appended claims are expressed. It will be appreciated by those skilled in the art that the teachings disclosed herein can be applied to other systems without departing from the scope and spirit of the application.

What is claimed is:

1. A blade for a gas turbine, the blade comprising:

a blade body having a leading edge, a trailing edge, and a pressure surface opposite from a suction surface, wherein the pressure and suction surfaces extend between the leading and trailing edges; and a trailing edge cooling channel extending between the pressure and suction surfaces in a downstream direction of a cooling fluid flow from a first upstream end to a second downstream end of the trailing edge cooling channel, wherein the trailing edge cooling channel is symmetrical along a camber line to the trailing edge, wherein a width of the trailing edge cooling channel in a direction perpendicular to the camber line of the blade varies in the downstream direction and the width is narrowest at the first upstream end; wherein the trailing edge is configured to be removed between the first upstream end and the second downstream end with a minimal change or no change in the cooling flow capacity through the trailing edge cooling channel.

2. The blade of claim 1, wherein the trailing edge cooling channel comprises a pin field with the pins in the pin field extending across the trailing edge cooling channel in the direction perpendicular to the camber line.

3. The blade of claim 2, wherein the pins nearest to the first upstream end are closer to one another than the pins nearest to the second downstream end.

4. The blade of claim 1, wherein the trailing edge cooling channel diverges in the downstream direction of the cooling fluid flow through the trailing edge cooling channel when in use.

5. The blade of claim 4, wherein the trailing edge cooling channel diverges for at least half of the distance from the first upstream end to the second downstream end.

6. The blade of claim 2, wherein the width of the trailing edge cooling channel in the direction perpendicular to the camber line is less in between the pins in the direction of the camber line than the width at the pins.

7. The blade of claim 1, wherein the narrowest width is situated more than 5%, more than 10%, more than 15% or more than 20% of the chord of the blade from the trailing edge.

8. A gas turbine comprising the blade of claim 1.

9. A system, comprising:

a blade, comprising:

a blade body having a leading edge, a trailing edge, and a pressure surface opposite from a suction surface, wherein the pressure and suction surfaces extend between the leading and trailing edges;

a trailing edge cooling channel extending between the pressure and suction surfaces in a downstream direction of a cooling fluid flow from an upstream end to a downstream end of the trailing edge cooling channel, wherein the trailing edge cooling channel is symmetrical along a camber line to the trailing edge, wherein the trailing edge cooling channel increases in width in the downstream direction between a throat and the downstream end; and a plurality of pins disposed in the trailing edge cooling channel downstream from the throat, wherein the plurality of pins are spaced apart from one another via one or more gaps in the downstream direction, and the plurality of pins extend across the trailing edge cooling channel between the pressure and suction surfaces, wherein a geometry of the blade is configured to be modified by cutting through the blade along a portion of the trailing edge cooling channel having the plurality of pins.

10. The system of claim 9, wherein the trailing edge cooling channel increases in width in the downstream direction along at least half of a distance between the throat and the downstream end.

11. The system of claim 9, wherein the trailing edge cooling channel extends through the trailing edge of the blade body, and the trailing edge is the second downstream end of the trailing edge cooling channel.

12. The system of claim 9, wherein the one or more gaps vary between the plurality of pins.

13. The system of claim 12, wherein the one or more gaps comprise a first gap upstream from a second gap, and the first gap is smaller than the second gap.

14. The system of claim 9, comprising a turbomachine having the blade.

15. The system of claim 14, wherein the turbomachine comprises a turbine.

16. The blade of claim 2, wherein the pin field has the pins positioned downstream of the first upstream end.

* * * * *